United States Patent [19]

Irwin

[11] 4,336,107

[45] Jun. 22, 1982

[54] ALIGNING DEVICE

[75] Inventor: Rodney C. Irwin, Monroeville, Pa.

[73] Assignee: Koppers Company, Inc., Pittsburgh, Pa.

[21] Appl. No.: 298,788

[22] Filed: Sep. 2, 1981

[51] Int. Cl.[3] ..... B61L 15/00; B61L 25/02; C10B 33/00; C10B 47/00

[52] U.S. Cl. ..... 202/239; 202/262; 202/270; 340/52 R; 340/686; 414/148

[58] Field of Search ..... 202/239, 262, 263, 270; 414/148, 215; 340/52 R, 686

[56] References Cited

U.S. PATENT DOCUMENTS

| | | | |
|---|---|---|---|
| 2,589,231 | 3/1952 | Drake . | |
| 2,730,707 | 1/1956 | Habeerle et al. | 414/148 |
| 2,760,270 | 8/1956 | Sims . | |
| 2,972,422 | 2/1961 | Stone . | |
| 3,017,622 | 1/1962 | Horsfall . | |
| 3,451,898 | 6/1969 | Lo Presti et al. . | |
| 3,464,894 | 9/1969 | Tatterson | 202/262 |
| 3,734,539 | 5/1973 | Salmi | 340/52 R |
| 3,921,830 | 11/1975 | Bright | 202/262 |
| 4,049,501 | 9/1977 | Lindgren | 202/262 |

*Primary Examiner*—Bradley Garris

*Attorney, Agent, or Firm*—Daniel J. Long; Oscar B. Brumback; Herbert J. Zeh, Jr.

[57] ABSTRACT

A projectable device for aligning rail mounted equipment with track side structures, and, in particular, for aligning a coke oven door extractor, pusher ram, or jamb cleaner with a coke oven door. In one embodiment, a rod having an attached terminal fork is extended horizontally toward the door so as to indicate alignment when an attached aligning plae is engaged by the fork. The rod projects from a piston and cylinder combination, and it is automatically withdrawn if alignment is correct. In a second embodiment, an arm having an attached terminal fork is swung downwardly in a vertical arc to engage the aligning plate and thereafter automatically returned to its initial, vertical position, if alignment is correct.

16 Claims, 12 Drawing Figures

ALIGNING DEVICE

BACKGROUND OF THE INVENTION

1. Field of the Invention

The present invention relates to devices for aligning rail mounted cars, carriages, or equipment with track-side structures, and in particular, with devices for aligning certain coke oven auxiliary equipment with coke oven doors.

2. Description of the Prior Art

On the completion of the coking process it is conventionally the practice to remove a pair of doors from the opposite sides of a coke oven and to extend a pusher ram into the oven from its pusher side so as to push the coke contained therein into a quenching car positioned adjacent the coke side of the oven. Included in the equipment necessary to carry out such a pushing operation is the abovementioned pusher ram as well as door extractor rams and jamb cleaners for the doors on both sides of the oven. These items of equipment, which will be collectively referred to, herein, as "auxiliary equipment", are typically mounted on cars which move on rails along the sides of the coke oven. The cars are stopped alongside a particular door and the abovementioned items of auxiliary equipment are, at the appropriate time during the pushing procedure, projected toward the door so as to perform their particular functions.

While this positioning would seem simple enough in principle, it is important that it be carried out with a certain degree of precision since even a small error in the positioning of a car relative to a coke oven door might result in damage to the door, the oven, or the auxiliary equipment, itself, when a misaligned item of auxiliary equipment is projected with force toward the door. Because it is often difficult for an operator to visually judge with sufficient precision when a car has been properly positioned, various devices have been developed for the purpose of indicating when alignment is correct. U.S. Pat. No. 3,451,898, for example, discloses an aligning device in which a rod, having a terminal fork that is engageable with the door frame, is mounted parallel with a door extractor ram and is moved forward toward the door with, but somewhat ahead of, the door extractor ram. In this device two limit switches are arranged in parallel such that the rear section of the rod opens one switch as the rod begins to be advanced toward the door. If alignment is correct, the rod will proceed forward until the fork engages and becomes fully seated on the door frame and a trip on the rod closes the second limit switch so that current to the door extractor ram's drive motor is not interrupted. If, however, alignment is not correct, the fork will not become seated on the door frame and the rod will consequently be prevented from proceeding far enough forward so that the second limit switch will not be closed, and current to the door extractor ram drive motor will be interrupted. The misaligned door extractor ram will, accordingly, be prevented from proceeding further toward the door.

While the device described above appears to accurately indicate whether a door extractor ram is aligned with a coke oven door, its use may be somewhat time consuming since it requires that the relatively slow moving extractor ram be moved forward with the indicator rod. Furthermore, after alignment has been completed, the usual procedure for employing this device would appear to require that the indicator rod remain in a forward and seated position on the door frame while the door extractor is in use. Because the indicator rod is so exposed, the possibility exists that it would be damaged during the pushing operation. It is, therefore, the object of the present invention to provide a device which quickly indicates whether a piece of projectable auxiliary equipment is aligned with a coke oven door without actually having to move such equipment toward the door. It is a further object of the present invention to provide an aligning device which has a minimal risk of being damaged during the coke pushing procedure.

SUMMARY OF THE INVENTION

The present invention includes a preferably hydraulic piston and cylinder combination which is mounted adjacent to a door extractor, pusher ram, or jamb cleaner and which has a rod projecting toward a coke oven door, the rod having a fork attached to its terminal end. Means are provided for expanding and compressing the cylinder so that the rod is moved toward or away from the door and the fork is moved in or out of engagement with an aligning plate attached adjacent the door. A control means for alternatively activating either said cylinder expanding or compressing means is provided, and mounted below the rod there is a limit switch operating bar which is moveable with the rod so that when the rod is fully extended a limit switch will be tripped, the effect of which is to activate the cylinder compressing means so as to and automatically withdraw the rod if alignment is correct. Preferably, this limit switch also activates the projectable piece of auxiliary equipment so that it will automatically proceed forward if it is in alignment with the door. The present invention may also be used to align any other type of rail mounted equipment with a track-side structure.

BRIEF DESCRIPTION OF THE DRAWINGS

The present invention is further described in the accompanying drawings in which.

DETAILED DESCRIPTION

Figure 1:
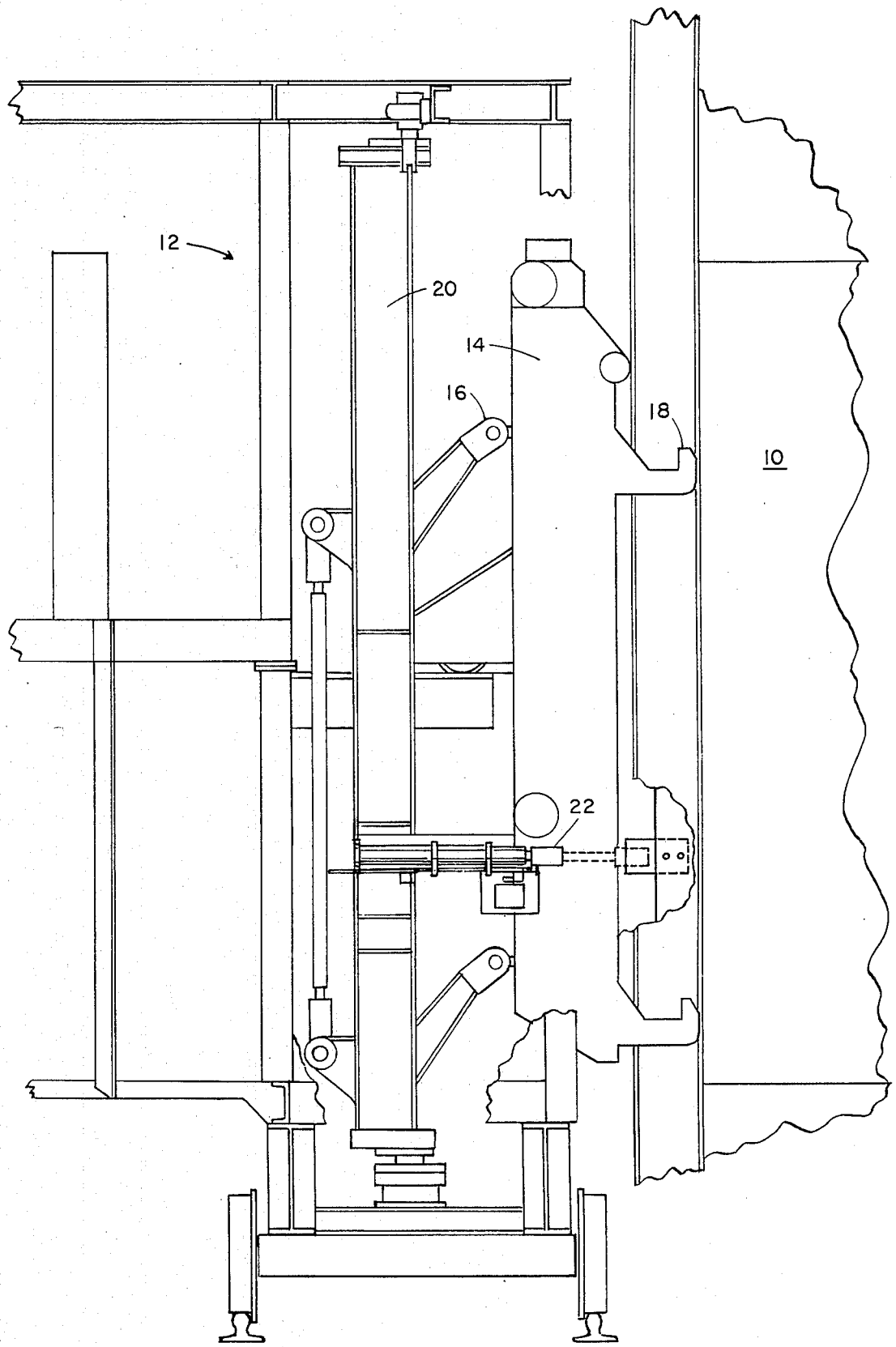
FIG. 1 is a cut-away side elevational view of a portion of a coke oven and a door extractor equipped with the aligning device of the present invention.

Referring to FIG. 1, a coke oven is shown, in fragment, at numeral 10, and a door machine which runs parallel to one side of the coke oven is also shown, in fragment, generally at numeral 12. This door machine is equipped with a door extractor 14 which is projectable toward the coke oven by means of door extractor ram 16 so as to remove coke oven doors by means of hooks as at 18. The door extractor ram is mounted on a door extractor cradle 20. Also mounted on the door extractor cradle 20 parallel to the door extractor ram 16 is the aligning device 22. The aligning device is shown in broken lines in an extended position as is explained below.

Figure 2:
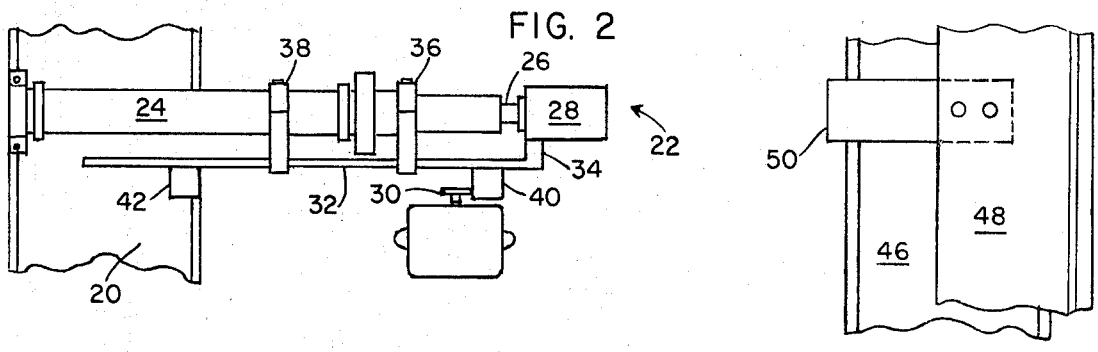
FIG. 2 is a side elevational view of the aligning device of the present invention.
Figure 3:
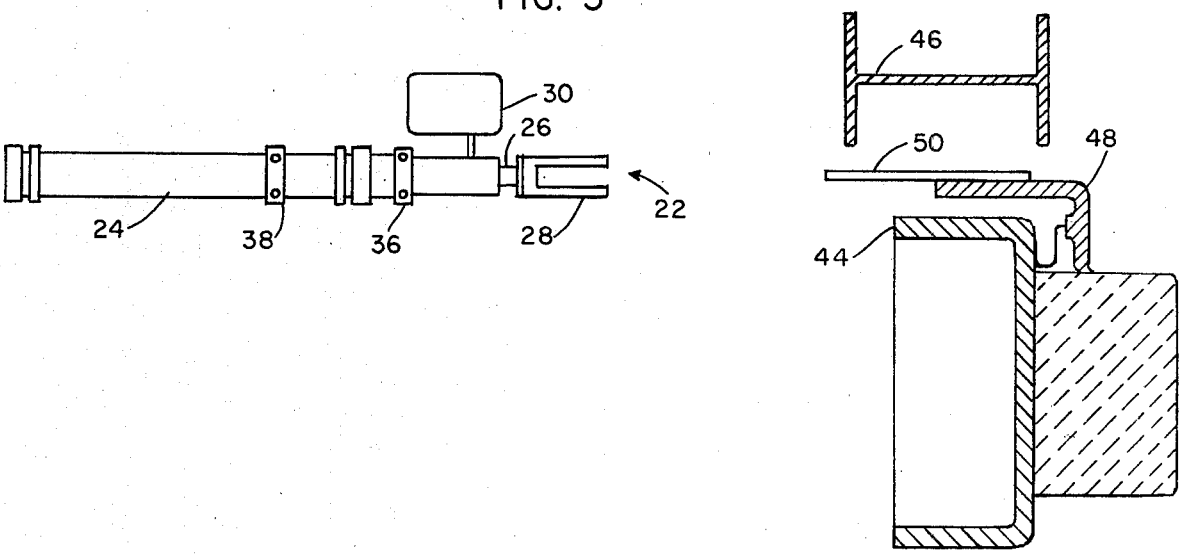
FIGS. 3–4 are plan views of the aligning device shown in FIG. 2.
Figure 4:
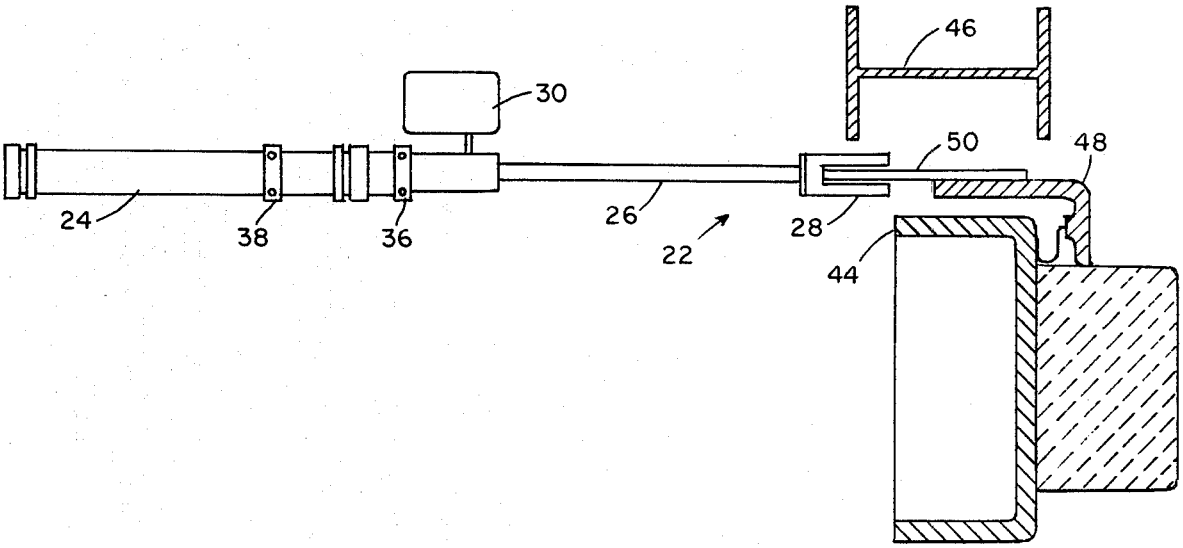

The aligning device 22 is shown in greater detail in FIGS. 2–4 from which it will be seen that the device is comprised of a hydraulic piston and cylinder combination 24 from which there extends a rod 26 which has at its terminal end an aligning fork 28. Positioned below the piston and cylinder combination 24 there is a limit switch 30 which is tripped by limit switch operating bar 32. The limit switch operating bar 32 is fixed to spotting fork 28 by bracket 34 and is also slideably suspended from piston and cylinder combination 26 by means of supports 36 and 38 which are fixed at their upper ends to piston and cylinder combination 24 and which have at their lower ends grooves (not shown) which have lower inwardly oriented flanges on which the limit switch operating bar 32 passes and is slideably retained. It will also be seen that limit switch operating bar 32 is equipped with a forward trip 40 and a rearward trip 42.

Still referring to FIGS. 2–4, there is shown, in section, the coke oven 10 as well as a coke oven door 44, a buckstay 46, and a door frame 48. Also shown is an aligning plate 50 which is attached to the door frame 48 to facilitate the use of the aligning device 22. FIGS. 2–3 show the aligning device when the piston and cylinder combination 24 is compressed and the rod 26 withdrawn. FIG. 4 shows the device when the piston and cylinder combination is expanded and the rod 26 extended. It will be seen from FIGS. 3–4 that the aligning device 22 is attached to the extractor cradle 20 in a position so that when the door extractor is satisfactorily aligned with the coke oven door the fork 28 will engage with and become seated on the aligning plate 50 when the piston and cylinder combination is extended in the manner shown in FIG. 4. It is noted that it is not mandatory that the fork become fully seated on the aligning plate. As will be apparent from the description, hereafter, the device of the present invention would be operable as long as there is some engagement between the fork and the aligning plate, or, in other words, as long as the terminal ends of the fork are extendable past the terminal end of the plate.

Figure 5A:
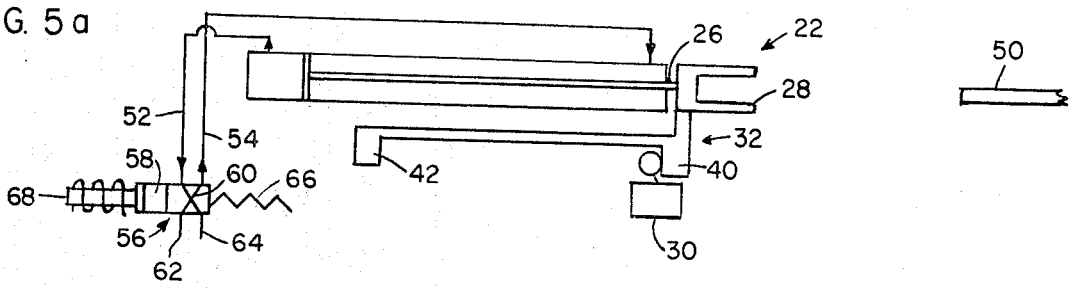
FIGS. 5*a*–5*f* are schematic diagrams showing the operation of the aligning device shown in FIG. 2.

The operation of the aligning device 22 is shown further in FIGS. 5*a*–5*f* from which it will be noted that on limit switch operating bar 32, forward trip 40 and a rearward trip 42 move limit switch 30 to a rearward, medial, or forward position. In FIG. 5*a* piston and cylinder combination 24 is shown in its compressed position. Hydraulic fluid may be provided to the rear of the piston in piston and cylinder combination 24 or withdrawn therefrom by means of a rearward line 52. Hydraulic fluid may also be provided to or withdrawn from the front of the piston by means of a forward line 54. At the other ends of rearward line 52 and forward line 54 from piston and cylinder combination 24 is a selector valve shown generally at 56. Valve 56 has a direct connection side 58 and a cross connection side 60, and the valve may be adjusted so that the rearward and forward lines 52 and 54 are engaged with either of these two sides. A spring offset valve which is suitable for use as valve 56 is manufactured by the Sperry Vickers Division of the Sperry Rand Corporation and is designated by that organization as Model No. DG 4S4-012A-50.

Figure 5B:
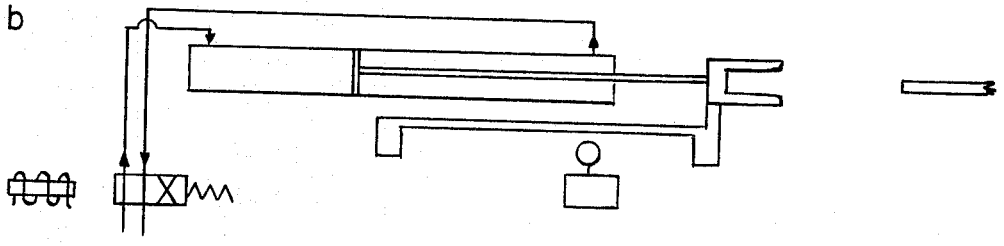

On the other side of valve 56 there is a hydraulic fluid pressure line 62 and a tank line 64. When valve 56 is adjusted so that rearward and forward lines 52 and 54 are engaged with the cross connection side 60 of the valve 56, the forward line 54 will be connected with pressure line 62 and the rearward line 52 will be connected with tank line 64 as is shown in FIG. 5*a*. When valve 56 is in this position the forward section of piston and cylinder combination 24 will be pressurized so, as is also shown in FIG. 5*a*, the piston and cylinder combination will be compressed. When the valve 56 is adjusted so that the direct connection side 58 is engaged with rearward and forward lines 52 and 54, said lines will be connected, respectively, with pressure line 62 and tank line 64 so, as is illustrated in FIG. 5*b*, the rearward section of the piston and cylinder combination 24 will be pressurized so as to expand the piston and cylinder combination.

It will also be noted that valve 56 is also equipped with spring 66 and that it may be adjusted by means of solenoid 68. When solenoid 68 is energized, direct connection side 58 will be moved to engage with forward and rearward line 52 and 54, and when it is not energized, spring 66 will push on valve 56 so as to engage its cross connection side 60 with lines 52 and 54. The starting position for the aligning device is shown in FIG. 5*a*. In this position the piston and cylinder combination 24 is compressed and the switch is in its rearward position. It is also preferable, but not essential, that means also be provided so that when switch 30 is in this rearward position the car on which the aligning device is mounted will be moveable alongside the coke oven. After the operator has moved said car to a position where he believes alignment is proper, he closes a manual switch (not shown) in a circuit which includes a power source (not shown) which energizes the solenoid 68 which, in turn, pushes valve 56 against spring 66. Valve 56 is, thus, adjusted in position from the one shown in FIG. 5*a*, where the cross connection side 60 is engaged with lines 52 and 54, to that shown in FIG. 5*b*, where direct connection side engages rearward line 52 and forward line 54 so that these lines are connected, respectively, with pressure line 62 and tank line 64. The pressurization of rearward line 52 and the rearward side of piston and cylinder combination 24 results in the expansion of piston and cylinder combination 24 and the extension of rod 26 toward aligning plate 50. As is shown in FIG. 5*b*, when the piston and cylinder combination begins expanding, forward trip 40 on limit switch operating rod 32 will be removed from switch 30 so as to cause the switch to move from its rearward position shown in FIG. 5*a* to its medial position shown in FIG. 5*b*. Preferably, means will also be provided so that the movement of the switch 30 to this medial position will lock the car on which the device is mounted in a fixed position relative to the coke oven.

Figure 5C:
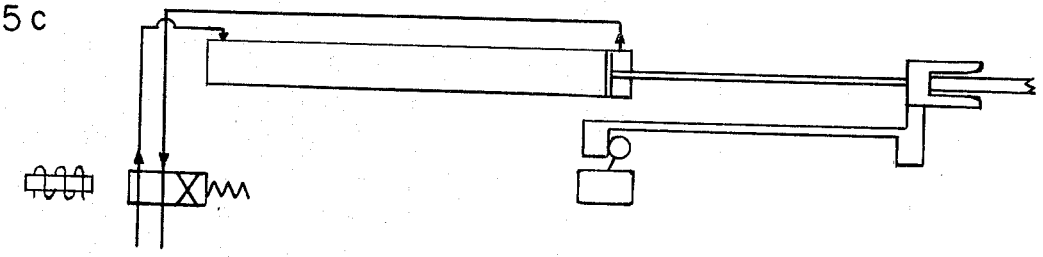
Figure 5D:
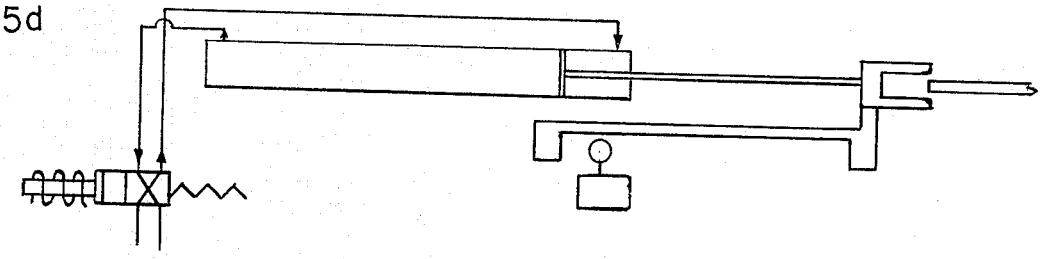
Figure 5E:
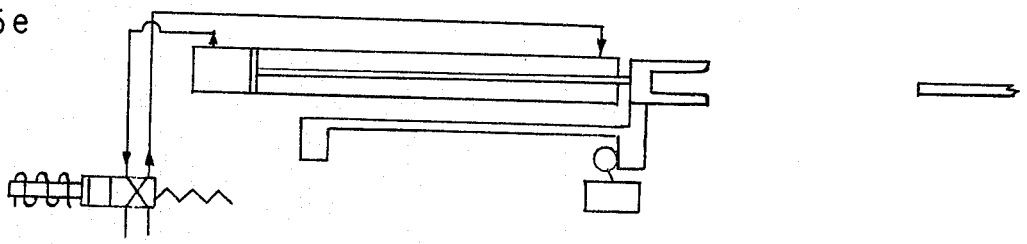
Figure 5F:
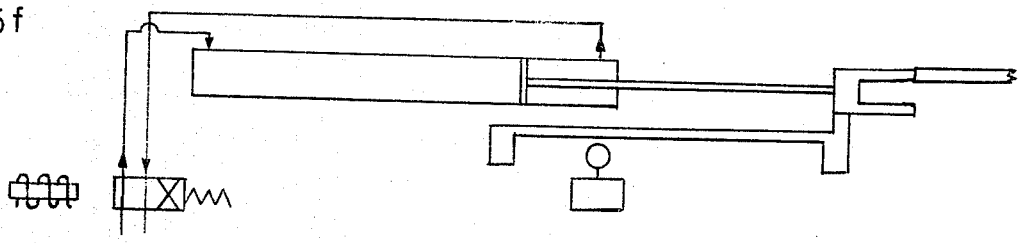

If alignment is correct, the expansion of the piston and cylinder combination 24 and extension of rod 26 will continue until the spotting fork 28 engages and becomes fully seated on spotting plate 50, as is shown in FIG. 5*c*, so as to indicate correct alignment. Still referring to FIG. 5*c*, it will be seen that when the rod 26 is sufficiently extended so that the spotting fork engages the spotting plate 50, then rearward trip 42 on limit switch operating bar 32 will trip switch 30 to its forward position. The movement of the switch 30 to this forward position will open the abovementioned solenoid circuit, so as to deenergize the solenoid 68. The deenergization of solenoid 68 will allow spring 66 to push valve 56 so that the lines 52 and 54 will engage cross connection side 60 so that forward line 54 will be connected with pressure line 62 and rearward line 52 will be connected with tank line 64. Thus, without the need for operator control, the piston and cylinder combination will begin to compress, as is shown in FIG. 5*d*, until it is fully withdrawn to its starting position shown in FIG. 5*e*. It will be seen from FIG. 5*f* that if the device is not in alignment with the spotting plate 50, the rod 24 will not be extended far enough forward so that the switch 30 will be moved to its forward position. The piston and cylinder combination 24 will not, therefore, be automatically compressed and the rod 26 not withdrawn, so as to thereby indicate to the operator that alignment is not correct. The operator will, therefore, be required to deenergize the solenoid 68 by means of his abovementioned manual switch and then adjust the position of the door machine relative to the door so as to achieve correct alignment. After the operator has observed that alignment is correct, he may then activate the extractor ram. Preferably, however, means will be provided so that the extractor ram will automatically begin to move toward the door when the switch 30 is tripped to its forward position shown in FIG. 5*c*.

It will be apparent to those skilled in the art that it would be possible to arrange the abovementioned solenoid and selector value in a number of ways so as to achieve the results obtained by the embodiments described herein. These variations are within the scope of this invention, and, in particular, it is noted that the procedure of energizing the solenoid to expand and of deenergizing the solenoid to compress the piston and cylinder combination is not critical. It is merely necessary that there be means for providing and cutting off current to the solenoid, and the use, hereafter, of the terms "one state of activation" and "other state of activation" with respect to the solenoid will refer to the two possible conditions where current either is or is not provided to the solenoid.

It will also be apparent that various equivalent structures can be substituted for the fork 28 and the aligning plate 50 so as to achieve the results described above. For example, a cylindrical, coaxial rod extension may be substituted on rod 26 for fork 28 and an aligning plate having a vertical, oblong slot, groove or aperature may be transversely mounted with respect to the rod and its coaxial extension, that is, mounted so that its face is perpendicular to the longitudinal axis of rod 26 and its extension. The slot should be positioned so that when alignment is correct the rod extension will pass through it so as to allow the limit switch to be tripped in a manner analogous to that illustrated in FIG. 5*c*. When alignment is not correct, the rod extension will miss the slot and abut the face of the aligning plate so as to prevent the limit switch from being tripped in a manner analogous to that illustrated in FIG. 5*f*. It is further noted that many other equivalent structures will be readily apparent to those skilled in the art, and, in particular, any terminal projection of rod 26 which passes through an aperture in an aligning attachment or which is, itself, traversed by such an attachment or which engages such an aligning attachment by means of convex and concave interfacing surfaces will be within the scope of the present invention. Any such terminal projection will be referred to, hereinafter, as an "aligning projection," and any such aligning attachment will be referred to as an "aligning plate."

It will also be understood that the aligning device 22, described above, may also be mounted adjacent to a jamb cleaner or a pusher ram, as well as a door extractor, so as to align those devices with a coke oven door. Regardless of the particular type of projectable auxiliary equipment with which it is used, the aligning device should be mounted adjacent to and in parallel arrangement with such equipment, that is, the forward motion of the aligning device should parallel that of the auxilliary equipment.

Figure 6:
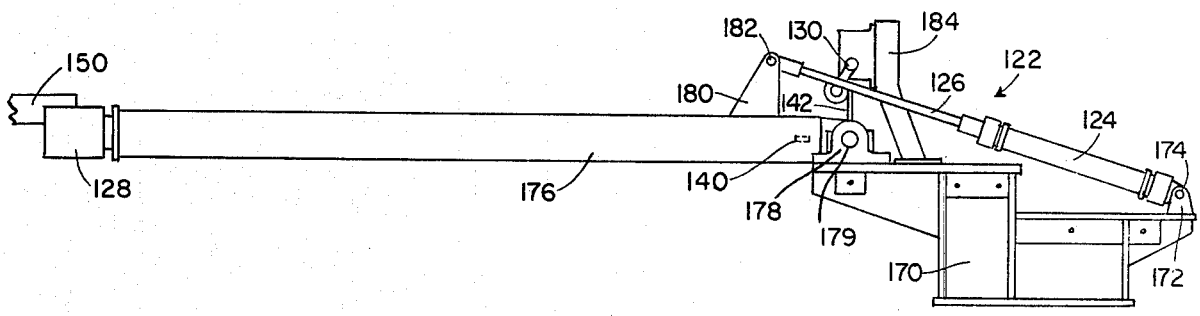
FIG. 6 is a side elevational view of an aligning device representing a second embodiment of the present invention.
Figure 7:
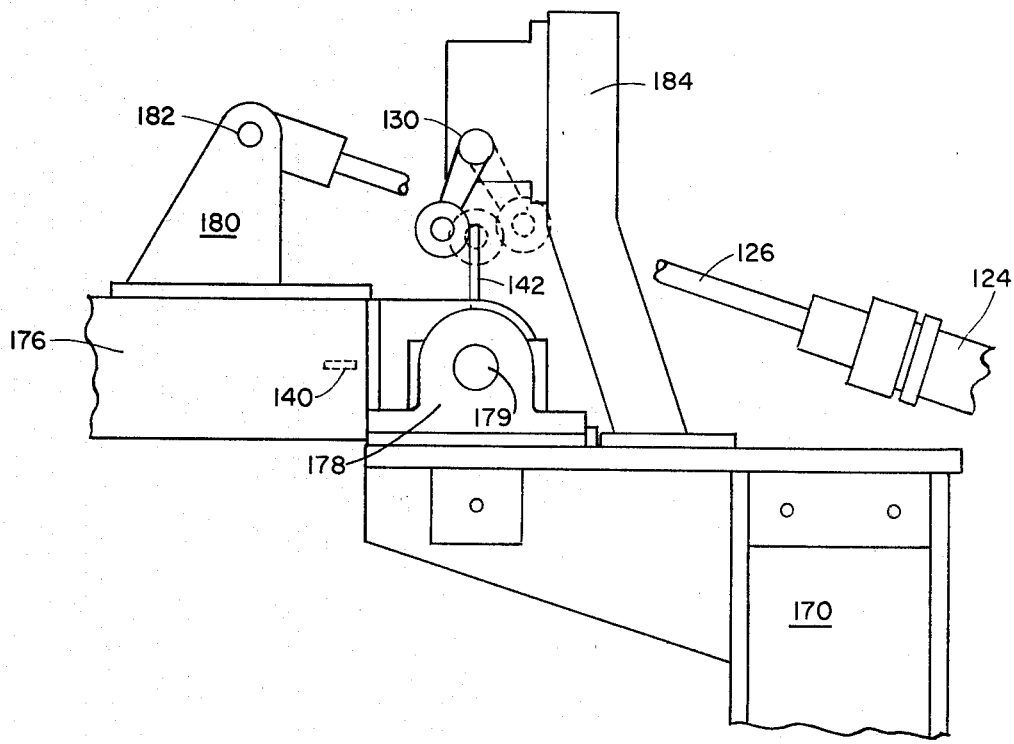
FIG. 7 is a detailed cut-away view of a part of the aligning device shown in FIG. 6.

A second embodiment shown in FIGS. 6–7 which is also suitable for use with all of the abovementioned items of auxiliary equipment may, however, be preferred in some cases, particularly for use in conjunction with a pusher ram. This aligning device, shown generally at numeral 122, is mounted on a base 170 which may be positioned adjacent a pusher ram on a pusher machine. The aligning device 122 has a hydraulic piston and cylinder combination 124 with an extendable rod 126. The piston and cylinder combination 124 is connected on its end opposite from rod 126 to rearward base bracket 172 which extends upwardly from base 170. Piston and cylinder combination 124 is pivotally connected to bracket 172 so as to be rotatable in a vertical arc on bearing 174. Disposed to the other end of the base 170 is an arm 176 having at its terminal end a spotting fork 128. Forward base bracket 178 extends vertically from base 170, and arm 176 is pivotally connected to this bracket so as to rotate in a vertical arc thereabout on bearing 179. Another bracket 180 extends vertically from arm 176, and rod 126 is pivotally connected thereto by means of bearing 182 so that as piston and cylinder group 124 is compressed and rod 126 withdrawn, arm 176 will be rotated upwardly in a vertical arc on bearing 179.

Also extending vertically from base 170 is limit switch bracket 184 which supports limit switch 130. Like limit switch 30 described above, limit switch 130 has a forward position, as is shown in FIG. 6, as well as a medial position in which the switch is angularly displaced to a vertical position, and a rearward position in which the switch is angularly displaced still further toward the limit switch bracket 184. FIG. 7 is a detailed view of the limit switch 130 and surrounding mechanisms in which the medial and rearward positions for the switch are shown in broken lines. From FIGS. 6 and 7 it will be seen that switch 130 is operated by a forward trip 140 and a rearward trip 142. The forward trip 140 projects radially and outwardly from the opposite side of the aligning device as illustrated and is shown in broken lines. The rearward trip 142 which projects radially from the top of arm 176 and in FIG. 6 it bears against switch 130 to hold it in its forward position.

It will be noted that the aligning device may be positioned in an elevated, and preferably vertical position, or in a lowered, and preferably horizontal position. In FIG. 6 the aligning device is shown in its horizontal position. When alignment is correct, fork 128 engages aligning plate 150 when the aligning device is disposed in this horizontal position. Additionally, the piston and cylinder combination 124 is expanded and the rod 126 is extended while the switch 130 is retained in its forward position by rearward trip 142 when the aligning device is horizontally disposed.

From the horizontal position shown in FIG. 6, the aligning device is rotated in a vertical arc on bearing 179 to the vertical position. In the vertical position the fork 128 is out of engagement with the aligning plate 150, piston and cylinder combination 124 is compressed, and rod 126 is withdrawn. In the vertical position, the switch 130 is also retained in its rearward position by forward trip 140. The aligning device will typically be held in its vertical position when it is not in use.

The operation of the aligning device 122 is similar to that of aligning device 22 as was described above in connection with FIGS. 5*a*–5*f*. Its starting position is typically the vertical position. By means of a similar apparatus and method as was described in connection with FIGS. 5*a*–5*f*, the operator initiates the pressurization and expansion of piston and cylinder combination 124. The consequential extension of rod 126 causes arm 176 to begin to rotate downwardly on bearing 179 which, in turn, allows switch 130 to rotate from its rearward to its vertical, medial position. Switch 130 is preferably connected by appropriate circuitry with the traction drive of the pusher machine so that this movement of switch 130 locks the pusher machine in place with respect to the coke oven. As the piston and cylinder combination 124 is further extended, the arm 176 will, if alignment is correct, swing into a position where the spotting fork 128 engages the aligning plate 150, as is shown in FIG. 6. When such engagement takes place, the switch 130 is tripped to the forward position shown in FIG. 6 by rearward trip 142 which has rotated from an initially horizontal to a vertical position. Also by means of apparatus similar to that illustrated and discussed above in connection with FIGS. 5*a*–5*f*, the movement of the switch 130 to this forward position will cause the piston and cylinder combination 124 to begin compressing and consequently the rod 126 will be withdrawn, thereby rotating the arm 176 on bearing 179 in a vertical arc back to its above described vertical starting position. In a way analogous to the situation illustrated in FIG. 5*f*, if one side of the spotting fork 128 prematurely abuts the aligning plate 150 because of misalignment, the switch 130 will not be tripped to the forward position so that the arm 176 will not automatically be returned to its vertical position nor will the pusher ram be automatically expanded in the above mentioned preferred embodiment. As the arm 176 is swung back to its vertical position, forward trip 140 will move switch 130, first its medial and then to its rearward position. Preferably, the movement of the switch 130 to its rearward position will cause the pusher ram or other auxiliary equipment to be automatically projected toward the coke oven door. Alternatively, however, the operator can observe the interaction of fork 128 with the aligning plate 150 and then, by means of manual controls, start the pusher ram toward the coke oven door.

Although the invention has been described with a certain degree of particularity, it is to be understood that the present disclosure has been made only as an example and that the scope of the invention is defined by what is hereafter claimed. It is also to be understood that the present invention is not restricted to uses in connection with coke oven auxiliary equipment, and that it may be successfully employed to align a wide variety of rail mounted cars, carriages, or other like equipment or vehicles with track-side structures. Accordingly, the scope of the present invention will be considered to encompass aligning devices as claimed hereinafter, regardless of the type of rail mounted equipment with which they are employed, and the term "rail mounted equipment" will be considered to include all rail mounted or traversing cars, carriages, or other vehicles regardless of whether such vehicles are self-propelled or externally propelled or whether or not they transport some other equipment or mechanism.

What is claimed is:

1. A device for aligning rail mounted equipment with a track-side structure comprising:

(a) a piston and cylinder combination having a rod projecting from the piston toward the track-side structure and having at the terminal end of said rod an aligning projection which is engageable with an aligning plate mounted adjacent the track-side structure;

(b) means for expanding said piston and cylinder combination so as to extend the rod to a point where the aligning projection engages the aligning plate;

(c) means for compressing said piston and cylinder combination so as to withdraw the rod from the point where the aligning projection engages the aligning plate;

(d) control means for alternatively activating either said means for expanding the piston and cylinder combination or said means for compressing said piston and cylinder combination;

(e) a limit switch connection with said control means such that said means for compressing the piston and cylinder combination is activated when said limit switch is tripped; and (f) a limit switch operating bar mounted adjacent said rod so as to be moveable therewith and having thereon a rearward trip positioned so as to trip the limit switch as the aligning projection engages the aligning plate, such that after the means for expanding the piston and cylinder combination have been employed to extend the rod to the point where the aligning projection engages the aligning plate, the means for compressing said piston and cylinder combination will then withdraw the rod.

2. The aligning device as defined in claim 1 including means for expanding and compressing said piston and cylinder combination by a hydraulic fluid.

3. The aligning device as defined in claim 2 wherein the limit switch is connected in electrical circuit with a power source and the control means.

4. The aligning device as defined in claim 3 wherein rearward and forward hydraulic lines are connected to opposite ends of the piston and cylinder combination and are also connected to a selector valve having a first position which connects said rearward line to a hydraulic fluid pressure source and a second position which connects said forward line to the hydraulic pressure source and wherein the position of the selector valve is controlled by an adjacent solenoid which is connected in electrical circuit with the limit switch and the power source such that when the limit switch is tripped the selector valve will move from its first position to its second position so as to compress the piston and cylinder combination.

5. The aligning device as defined in claim 4 wherein there is provided an unpressurized hydraulic fluid tank line which is connected to the forward hydraulic line when the selector valve is in its first position and to the rearward hydraulic line when the selector valve is in its second position.

6. The aligning device as defined in claim 1 wherein the aligning device is mounted on a car which is moveable alongside the track-side structure and wherein the limit switch is tripped to a forward position to activate the means for compressing the piston and cylinder combination and wherein said limit switch also has a medial position which activates a means for locking the car into a fixed position relative to the track-side structure and a rearward position which deactivates said means for locking the car in a fixed position relative to the track-side structure.

7. The aligning device as defined in claim 6 wherein there is provided a manual control means for initially activating the means for expanding the piston and cylinder combination.

8. The aligning device as defined in claim 7 wherein there is provided a second, forward trip which bears against the switch when the piston and cylinder combination is compressed, so as to retain said limit switch in the rearward position until the manual control means for initially activating the means for expanding the piston and cylinder combination is used, after which the forward trip releases the switch to allow it to be displaced to its medial position.

9. A device for aligning rail mounted equipment with a track-side structure comprising:

(a) a hydraulic piston and cylinder combination having a rod projecting from the piston toward the track-side structure and having at the terminal end of said rod an aligning projection which is engageable with an aligning plate mounted adjacent to the track-side structure;

(b) a hydraulic fluid pressure source;

(c) a rearward hydraulic line connected at one end of the piston and cylinder combination so as to expand said piston and cylinder combination when connected at its other end to the hydraulic fluid pressure source;

(d) a forward hydraulic line connected at one end to the piston and cylinder combination so as to compress said piston and cylinder combination when connected at its other end to the hydraulic fluid pressure source;

(e) a selector valve positionable by a solenoid and having a first position which connects the rearward hydraulic line to the hydraulic pressure source when the solenoid is in one state of activation and a second position which connects the forward hydraulic line to the hydraulic pressure source when the solenoid is in the other state of activation;

(f) a limit switch connected in electrical circuit with a power source and said solenoid such that the state of activation of the solenoid is changed when the limit switch is tripped; and (g) a limit switch operating bar mounted adjacent the rod so as to be moveable therewith and having thereon a rearward trip positioned so as to trip the limit switch as the aligning projection engages the aligning plate, such that after the selector valve has been initially positioned in its first position so as to expand the piston and cylinder combination and extend the rod to a point where the aligning projection engages the aligning plate, the selector valve will then be positioned in its second position so as to withdraw the rod.

10. The aligning device as defined in claim 9 wherein there is provided an unpressurized hydraulic fluid tank line which is connected to the forward hydraulic line when the selector valve is in its first position and to the rearward hydraulic line when the selector valve is in its second position.

11. The aligning device as defined in claim 9 wherein the selector valve is in the second position when the solenoid is energized and is in the first position when the solenoid is deenergized and there is provided a manual control means for initially energizing the solenoid so as to expand the piston and cylinder combination and wherein the tripping of the limit switch deenergizes the solenoid so as to compress the piston and cylinder combination.

12. The aligning device as defined in claim 11 wherein the aligning device is mounted on a car which is moveable alongside the track-side structure and wherein the limit switch is tripped to a forward position to deenergize the solenoid and wherein said limit switch also has a medial position which activates a means for locking the car into a fixed position relative to the track-side structure and a rearward position which deactivates said means for locking the car into a fixed position relative to the track-side structure.

13. The aligning device as defined in claim 12 wherein there is provided a second, forward trip which bears against the switch when the piston and cylinder combination is compressed, so as to retain said limit switch in the rearward position until the manual control means for initially energizing the solenoid is used, after which the forward trip releases the switch to allow it to be displaced to its medial position.

14. The aligning device as defined in claim 1 or 9 wherein said device is mounted adjacent to a piece of projectable coke oven auxiliary equipment so as to align said equipment with a coke oven door.

15. The aligning device as defined in claim 1 or 9 wherein the aligning projection is a fork and the aligning plate is mounted longitudinally with respect to said fork and is engageable endwise therewith.

16. The aligning device as defined in claim 1 or 9 wherein the aligning projection is a cylindrical rod extension and the aligning plate is mounted transversely with respect to said rod extension and said plate has a vertical, oblong slot so as to be engageable with said rod extension by insertion of said rod extension into said slot.

* * * * *

UNITED STATES PATENT AND TRADEMARK OFFICE

CERTIFICATE OF CORRECTION

PATENT NO. : 4,336,107

DATED : June 22, 1982

INVENTOR(S) : Rodney C. Irwin

It is certified that error appears in the above-identified patent and that said Letters Patent are hereby corrected as shown below:

At Column 8, Line 22 "connection" should read --connected--

At Column 9, Line 27 "of" should be --to--.

Signed and Sealed this

*Twenty-eighth* Day of *December 1982*

[SEAL]

*Attest:*

GERALD J. MOSSINGHOFF

*Attesting Officer*

*Commissioner of Patents and Trademarks*